United States Patent [19]

Dyer et al.

[11] 4,279,099

[45] Jul. 21, 1981

[54] FIGURE TOY

[75] Inventors: Robert F. Dyer, Rancho Palos Verdes; J. Stephen Lewis, Pacific Palisades; Janice E. Rosenthal, Manhattan Beach; James P. Mills-Winkler, Torrance; Robert F. Schroeder, Long Beach, all of Calif.

[73] Assignee: Mattel, Inc., Hawthorne, Calif.

[21] Appl. No.: 102,068

[22] Filed: Dec. 10, 1979

[51] Int. Cl.[3] ..... A63H 13/00

[52] U.S. Cl. ..... 46/119; 46/173

[58] Field of Search ..... 46/118, 119, 161, 162, 46/163, 173

[56] References Cited

U.S. PATENT DOCUMENTS

| | | | |
|---|---|---|---|
| 2,047,377 | 7/1936 | Liwschutz | 46/118 X |
| 2,279,603 | 4/1942 | Wallis | 46/119 |
| 2,401,456 | 6/1946 | Bresch | 46/118 |
| 3,377,740 | 4/1968 | Bonanno et al. | 46/119 |
| 3,921,332 | 11/1975 | Terzian | 46/161 |
| 4,197,358 | 4/1980 | Garcia | 46/162 X |

FOREIGN PATENT DOCUMENTS

| | | | |
|---|---|---|---|
| 108361 | 2/1900 | Fed. Rep. of Germany | 46/161 |

*Primary Examiner*—F. Barry Shay

*Attorney, Agent, or Firm*—Reagin & King

[57] ABSTRACT

A figure toy which includes a unique actuating mechanism which cooperates with a novel shoulder assembly which allows the toy to emulate a shrug or a wave and to perform other functions of the same sort in a very realistic manner. The shoulder assembly includes a member which pivots about one end when it receives pressure from the actuating mechanism. The other end of the assembly is attached to an arm. Thus, the motion of the shoulder assembly moves the shoulder upwardly and inwardly simulating very closely the raising of the human shoulder such as occurs during a shrug or a wave. The arrangement allows one or the other or both of the shoulders together to be raised.

4 Claims, 6 Drawing Figures

FIGURE TOY

BACKGROUND OF THE INVENTION

This invention relates to toys and, more particularly, to figure toys designed to emulate humans.

There have been a myriad of toys developed over the years. Many of these toys have become classics and have been reproduced again and again. Those toys which have lasted have certain common characteristics. First, they provide a substantial amount of excitement for the child. Second, they are well made and durable so that the child may play with them over a long period of time. Next, they are sufficiently inexpensive that they appeal to a broad market. Meeting these criteria has posed a substantial problem for many prior art toys.

A toy and especially a figure toy can be made more exciting for a child if it can be made more realistic. There are many figure toys known to the prior art and many of these toys perform relatively simple functions performed by humans. For example, such figure toys may be posed in various life-like positions and move their limbs in various ways. However, most of these movements are, in essence, rotational movements which are quite unlike many of the movements performed by humans. For example, figure toys have arms which rotate at the shoulder to emulate a wave. Human arms describe a much more complicated motion in waving. Attempts to accomplish more realistic movements have proven to be very expensive and, consequently, impractical.

It is an object of the present invention to provide a new and improved figure toy.

It is another object of the present invention to provide a sturdy, inexpensive, and realistic figure toy.

It is still another object of the present invention to provide a new and improved figure toy which performs a number of relatively complicated life-like actions.

SUMMARY OF THE INVENTION

The foregoing and other objects of the invention are accomplished by a figure toy which has a unique actuating mechanism which cooperates with a novel shoulder assembly to simulate a shrug or a wave and to perform other functions of the same sort in a very realistic manner. The shoulder assembly pivots about a first end when it is moved by pressure from the actuating mechanism and moves a second end to which is attached an arm at the shoulder. The motion at the shoulder simulates very closely the raising of the human shoulder such as occurs during a shrug or a wave. The arrangement is such that one or the other or both of the shoulders together may be raised and different human actions imitated.

Other objects, features, and advantages of the invention will become apparent from a reading of the specification taken in conjunction with the drawings in which like reference numbers refer to like elements in the several views.

DESCRIPTION OF THE PREFERRED EMBODIMENT

Figure 1:
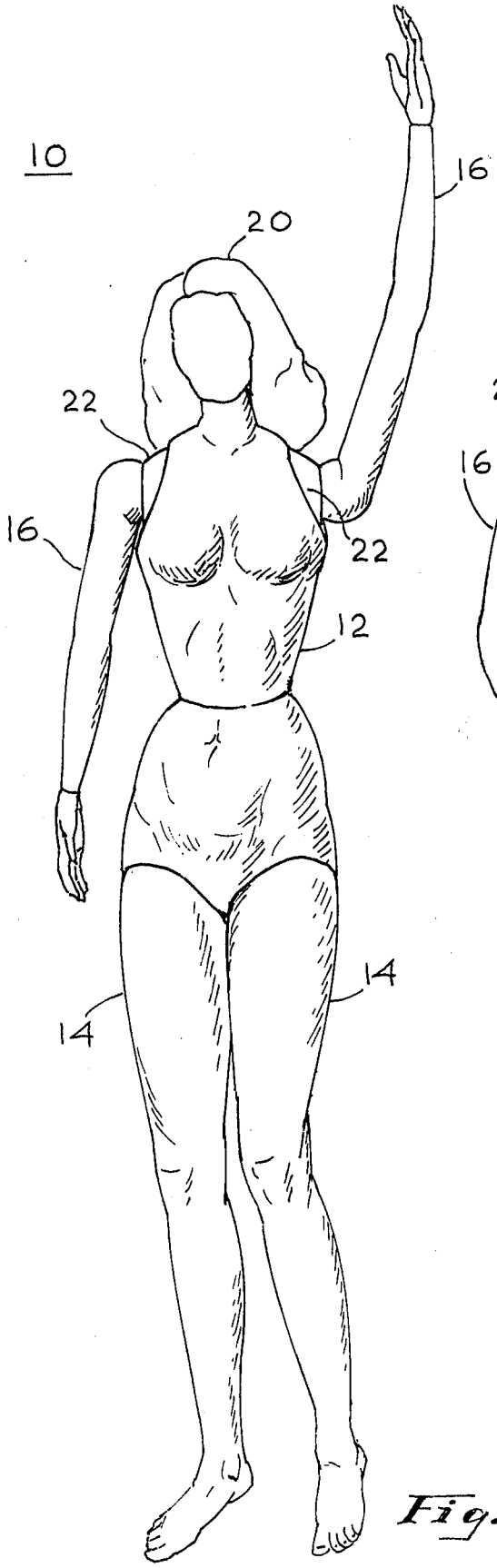
FIG. 1 is a front view of a figure toy, constructed in accordance with this invention, in a first position with one arm raised.
Figure 2:
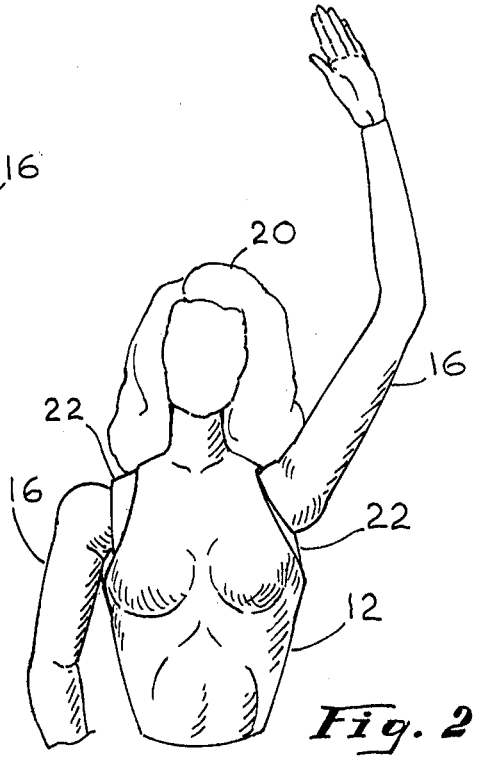
FIG. 2 is a partial front view of the figure toy shown in FIG. 1 with one arm raised as though waving.

Referring now to the drawings and, more particularly, to FIG. 1, there is shown a figure toy 10 constructed in accordance with the invention. The toy 10 has a body 12 to which are mounted a pair of legs 14, a pair of arms 16, and a head 20. The arms 16 are mounted to the body 12 by shoulder assemblies 22. Each of the arms 16 is mounted in the associated shoulder assembly 22 so that it both rotates in a circle about the shoulder and raises so that the toy 10 is capable of emulating various human actions. For example, either arm 16 may be rotated upwardly so that the toy 10 appears to be reaching upwardly or waving (as is the left arm 16 in FIG. 1). However, when an arm 16 is simply rotated upwardly in the shoulder assembly 22, the position attained thereby is (like the position attained in prior art figure toys) not the position naturally assumed by a human. The actual position which a human arm and body assume is accomplishing the act of waving is shown in FIG. 2 in which the figure toy 10 (shown in truncated form) has an arm 16 raised and in which the shoulder assembly 22 in which the raised arm 16 is positioned has moved upwardly and inwardly with regard to the vertical center line of the torso. This, in fact, is the actual position assumed by the human arm in most motions in which the arm is raised so that the hand rises above the line of the shoulder. It is also easy to see by looking at FIGS. 1 and 2 that the toy 10 in FIG. 2 does in fact appear to be waving as does a person while the motion in FIG. 1 appears stilted.

Figure 3:
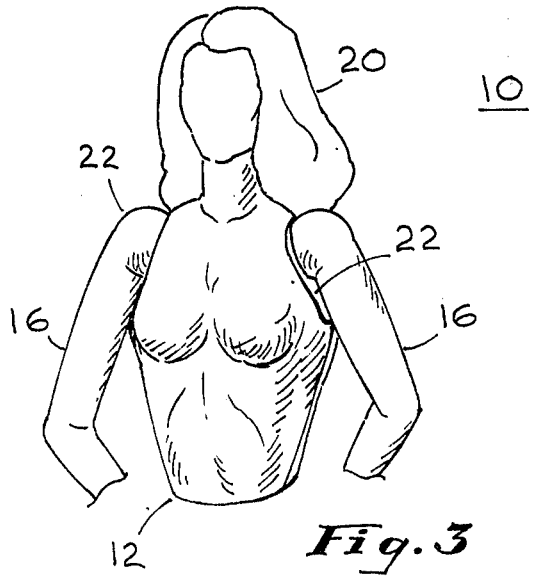
FIG. 3 is a partial front view of the figure toy illustrated in FIG. 1 with both shoulders raised as if shrugging.

FIG. 3 illustrates the same figure toy 10 in a position in which the shoulder assemblies 22 have both been raised and moved inwardly so that both shoulders appear to have moved upwardly and inwardly. This is a position assumed by a human when that person shrugs. Again, the position accurately simulates the position of a human; no known prior art figure toy is able to emulate this position.

Figure 4:
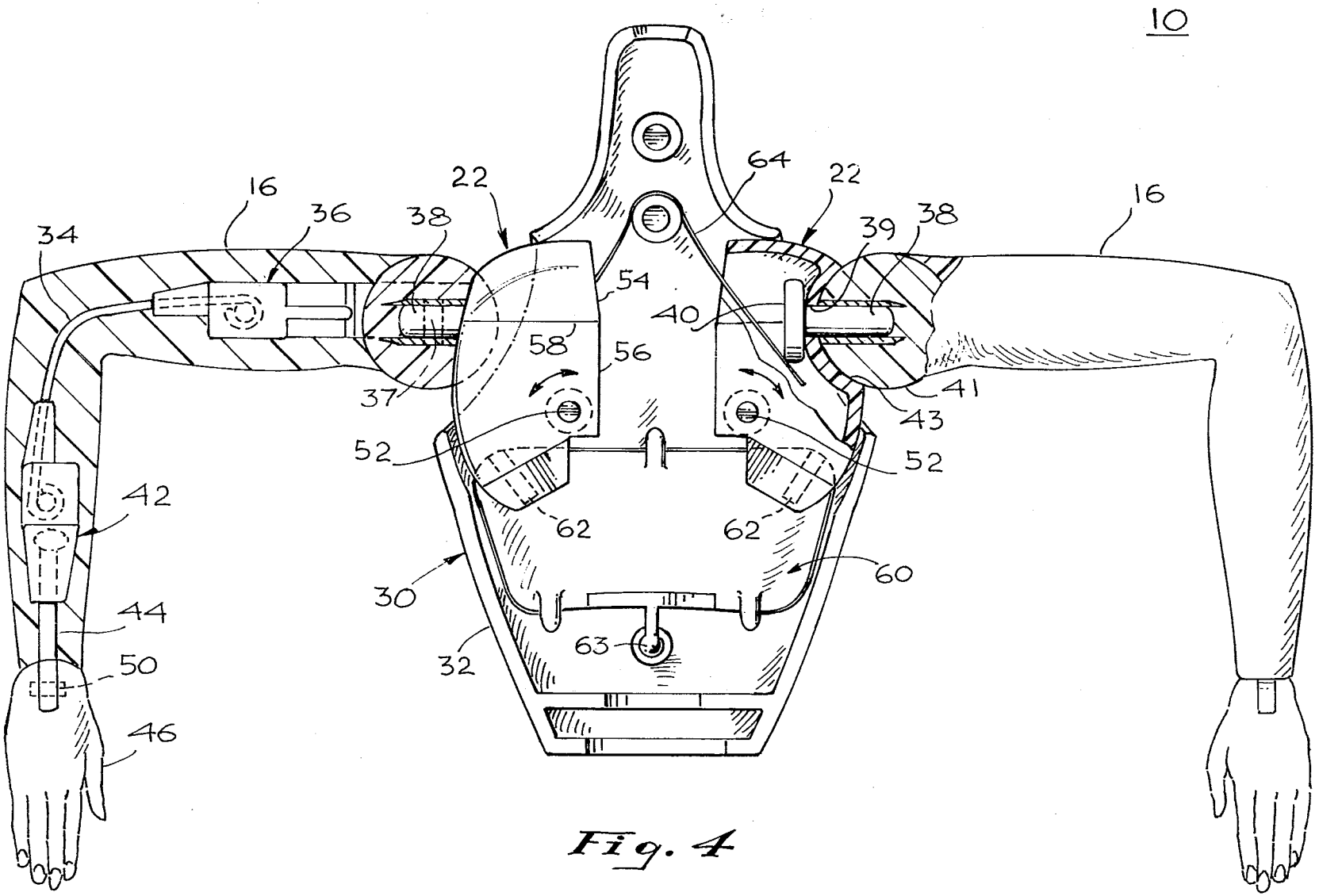
FIG. 4 is a front view of the internal mechanism of the torso of the doll shown in FIG. 1.

The unique arrangement by which the figure toy 10 is able to accomplish this particular shrugging motion and similar motions is more particularly illustrated in FIG. 4, a front view of the upper torso of the figure toy with the front body shell removed to disclose the inner mechanism. The figure 10 shown in FIG. 4 has an upper torso 30 which comprises a back shell 32 and a front shell 33 (shown in FIG. 5). The back and front shells 32 and 33 mate together and are sealed by means well known in the art to form the upper torso 30. Positioned within the interior of the upper torso 30 are a pair of shoulder assemblies 22 each of which may be molded from a plastic material such as Acetal to provide a socket for an arm 16. The left shoulder assembly 22 and the right arm 16 are shown in cross-section in FIG. 4.

The arm 16 includes a center wire 34 which may be bent to emulate bending of a human arm at the elbow. The wire 34 is held in place by an upper assembly 36 which connects to a shoulder joint 38. The shoulder joint 38 connects to the assembly 36 by a pivot 37 so that the arm 16 may be rotated forwardly and backwardly as shown in FIG. 4. The shoulder joint 38 also has a cylindrical portion which extends into the shoulder assembly 22 through an aperture 39 therein (as more particularly shown with regard to the left arm shown in FIG. 4) and ends in a knob 40. The upper arm ends in a spherical surface 41 which fits into a matching cavity 43 in the outer surface of the assembly 22. The extension of the shoulder joint 38 into the shoulder assembly 22 ending in knob 40 allows the shoulder to rotate within the cavity 43 shown in the shoulder assembly.

The wire 34 also connects to a lower assembly 42 in which is rotatably mounted a knobbed pin 44 to which is mounted a hand 46. The pin 44 rotates about its axis in the assembly 42 while the hand 46 rotates about the axis of a pin 50 so that it may be placed in a variety of positions. Overlaying the wire 34 and the assemblies 36, 42, and 44 is a soft plastic which gives shape to the arm 16 and may be bent with the wire 34. An arm 16 so formed is capable of assuming any number of positions which fairly accurately simulate positions assumed by the human arm. The arm 16 may be rotated upwardly at the shoulder joint 38, for example, so that the hand 46 lies above the shoulder essentially parallel with the face. The arm 16 may also be straightened and assume various positions which might be taken by a straight arm. However, all of these positions are well known to the prior art. The unique connection of the arm 16 by the shoulder joint 38 to the shoulder assembly 22 allows the toy 10 to more closely emulate various natural positions of the human body.

The shoulder assembly 22 is mounted to the back shell 32 and the front shell 33 by a pin 52 which acts as a pivot for the shoulder assembly 22 allowing the shoulder assembly 22 to move as shown by the arrow adjacent the pin 52 in FIG. 4. In so moving, the shoulder assembly 22 carries the arm 16 so that the upper arm joining the assembly 22 moves inwardly and upwardly. This is the motion which a human arm makes in various actions such as waving and shrugging. Consequently, the toy 10 may be made to emulate human movements in which the shoulder rises above its normal position and inwardly.

Figure 6:
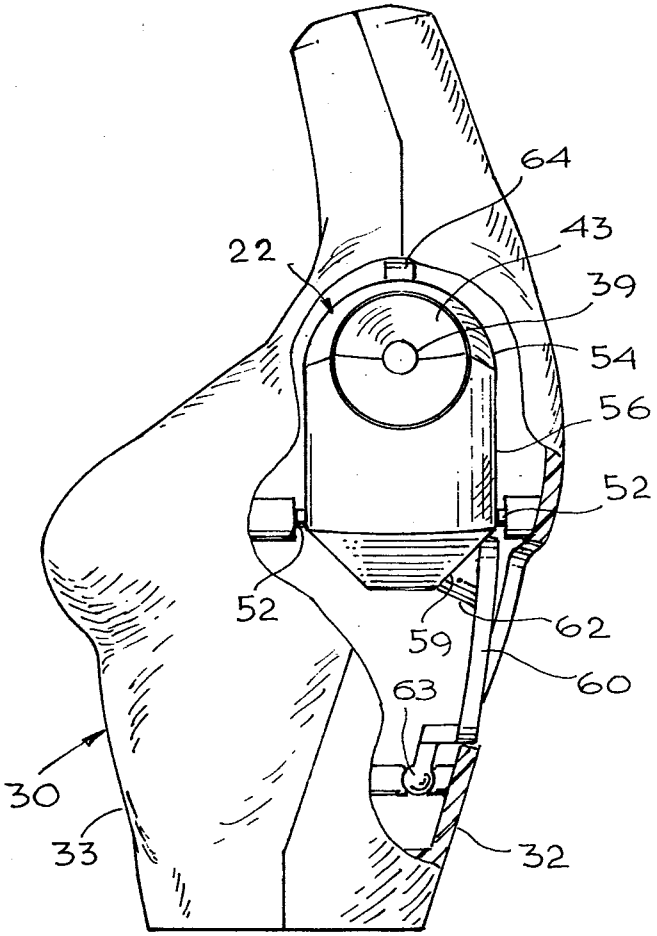
FIG. 6 is another side view of the mechanism illustrated in FIG. 4.
Figure 5:
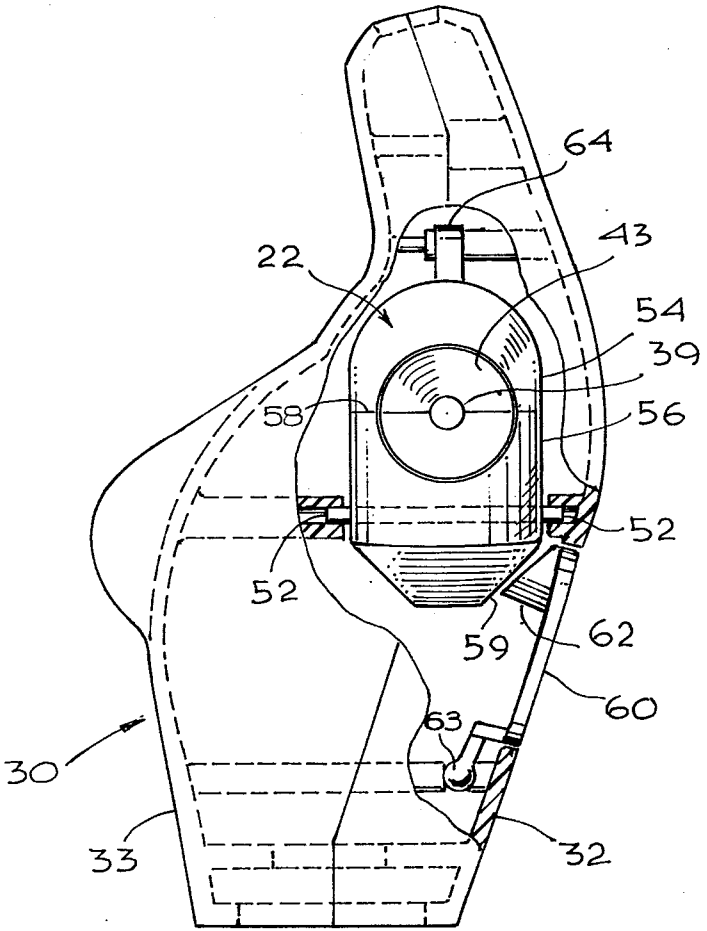
FIG. 5 is a side view partially cut away of the torso illustrated in FIG. 4 showing details of the shoulder mechanism and actuating mechanism.

As may be seen in FIGS. 4, 5, and 6, the shoulder assembly 22 is constructed of two halves 54 and 56 which join together along a line 58 to allow the insertion of the shoulder joint 38 with the knob 40. The lower half 56 of the assembly 22 has a rearwardly facing lower surface 59 which slopes at approximately a 45° angle from the vertical. A plate actuator mechanism 60 has molded thereon a pair of projections 62 which in operation are forced against the rear surfaces 59 of the mechanisms 22 and cause each to slide upwardly, pivoting about the pins 52. Pressure on the exterior of the actuator mechanism 60 as applied by a thumb causes the upper portion of the mechanism 60 to rotate about a ball 63 producing an inward motion of the projections 62 thereby causing the upward rotational movement of the assemblies 22. As may be seen in FIG. 4, such pressure on either of the assemblies 22 causes that individual assembly to move upward carrying the arm 16 with it. The shape of the outer surface of the assembly 22 is such that it rotates within the torso 30, and the upper arm 16 at the shoulder moves along a radius from the pin 52 upwardly and inwardly. The particular assembly 22 is returned to its normal position by a spring 64 upon the relaxation of the thumb's pressure applied to the actuator mechanism 60.

The ball 63 projects inwardly from the lower center of the actuator mechanism 60 so that thumb pressure in the center of the actuator mechanism 60 causes both of the assemblies 22 to pivot about the pins 52 at the same time thereby causing both of the arms to raise in a shrug (or an upward reach, if the arms are stretched upwardly) while pressure to either side of the center causes only one of the assemblies 22 to pivot. Consequently, the arrangement of this invention allows the selective movement of one or the other or both of the arms above the line of the shoulder to emulate various human motions.

The figure toy 10 shown in the drawings may be constructed of various material such as moldable plastics adapted to provide long life and ease of production. For example, the major portions of the exterior body of the toy 10 may be made of a material such as acrylonitrile-butadiene-styrene which forms easily into molded shapes characteristic of the human form. On the other hand, the internal mechanism may in general be molded of a material such as Acetal which may be easily molded yet exhibits substantial resistance to wear. The internal parts of the arms such as assemblies 36 and 42 may be molded of a material such as polypropylene. Obviously, other materials might be substituted for these without departing from the spirit of the invention.

While a preferred embodiment of the invention has been shown and described, it is to be understood that various other adaptations and modifications might be made within the spirit and scope of the invention.

What is claimed is:

1. In combination with a figure toy including an upper torso having a shoulder region, an arm having a spherical surface at its upper end and a shoulder joint on said arm for connecting said spherical surface to said shoulder region, the improvement which comprises:

an opening provided in said shoulder region;

a shoulder assembly projecting through said opening and contoured to have the external appearance of at least a portion of a shoulder on said figure toy;

a pivot swingably connecting said shoulder assembly to said upper torso in said opening for movement in a manner simulating natural shoulder movement; and an aperture and an aligned cavity provided in said shoulder assembly for rotatably receiving said shoulder joint and said spherical surface, respectively, said upper torso, arm and shoulder assembly forming a substantial part of the external contour of said figure toy.

2. An improvement as recited in claim 1 including means mounted to said upper torso adjacent said shoulder assembly for moving said shoulder assembly about said pivot as a means of moving said arm.

3. An improvement as recited in claim 2 wherein said shoulder assembly includes a rearwardly facing surface below said pivot, said surface sloping at approximately a 45° angle from the vertical when said figure toy is in an erect position and wherein said means for moving said shoulder assembly comprises a plate actuator mechanism and means for articulately mounting said plate to said upper torso.

4. In combination with a figure toy including an upper torso having a shoulder region, a push plate swingably mounted to said upper torso and forming a continuation of an outer surface thereof, an arm having a spherical surface at its upper end and a shoulder joint on said arm for connecting said spherical surface of said shoulder region, the improvement which comprises:

an opening provided in said shoulder region;

a shoulder assembly projecting through said opening and contoured to have an external appearance of at least a portion of a shoulder on said figure toy;

a pivot swingably connecting said shoulder assembly to said upper torso in said opening adjacent said push plate for movement in a manner simulating natural shoulder movement;

an aperture and an aligned cavity provided in said shoulder assembly for rotatably receiving said shoulder joint and said spherical surface, respectively; and means operatively coupling said push plate to said shoulder assembly for rotating said shoulder assembly about said pivot for simulating said natural shoulder movement when said push plate is actuated.

* * * * *